US011352167B2

(12) United States Patent
Yen

(10) Patent No.: US 11,352,167 B2
(45) Date of Patent: Jun. 7, 2022

(54) PACKING BOX AND METHOD OF USING THE SAME

(71) Applicant: INTERNATIONAL DESIGN PACKING CO., LTD., Suzhou (CN)

(72) Inventor: Wentai Yen, Suzhou (CN)

(73) Assignee: INTERNATIONAL DESIGN PACKING CO., LTD., Suzhou (CN)

( * ) Notice: Subject to any disclaimer, the term of this patent is extended or adjusted under 35 U.S.C. 154(b) by 112 days.

(21) Appl. No.: 16/629,426

(22) PCT Filed: Sep. 29, 2018

(86) PCT No.: PCT/CN2018/108660
§ 371 (c)(1),
(2) Date: Jan. 8, 2020

(87) PCT Pub. No.: WO2020/062147
PCT Pub. Date: Apr. 2, 2020

(65) Prior Publication Data

US 2021/0094726 A1 Apr. 1, 2021

(51) Int. Cl.
*B65D 5/50* (2006.01)
*B65D 5/22* (2006.01)
(Continued)

(52) U.S. Cl.
CPC ..... *B65D 5/5038* (2013.01); *B31B 50/26* (2017.08); *B65D 5/22* (2013.01); *B65D 5/4266* (2013.01);
(Continued)

(58) Field of Classification Search
CPC ..... B65D 5/5038; B65D 5/22; B65D 5/4266; B65D 71/72; B65D 5/4802; B65D 5/5021; B65D 2571/00925; B31B 50/26
(Continued)

(56) References Cited

U.S. PATENT DOCUMENTS 2,771,232 A 11/1956 Reed
3,104,046 A * 9/1963 Arneson ..... B65D 71/0022 229/117.18
(Continued)

FOREIGN PATENT DOCUMENTS

CN 201457825 5/2010
CN 102883962 1/2013
(Continued)

*Primary Examiner* — Christopher R Demeree

(57) ABSTRACT

The invention provides a packing box and a method of using the same, comprising a base surface, side surfaces and receiving compartments; wherein the side surfaces and the base surface form first set of folding marks used to fold along the first folding marks and form a space for the packing box; a plurality of holes are opened on the base surface, and the receiving compartments are fixed on the base surface, with the holes used as openings thereof; each receiving compartment is surrounded by a plurality of wall surfaces, the wall surfaces unparallel to the base surface when the receiving compartments are expanded are defined as unparallel wall surfaces, the other wall surfaces are parallel wall surfaces, and a plurality of second folding marks are formed on the unparallel wall surfaces to be used to fold and expand the corresponding wall surfaces; wherein, when the unparallel wall surfaces are folded, the internal cavities of the receiving compartments disappear and the receiving compartments are retracted, and when the unparallel wall surfaces are expanded, the receiving compartments are expanded. The proposal of the invention has advantages that the space occupied by the packing box can be reduced during transportation and storage, the packing box can be formed conveniently and quickly, and the final packing box structure is stable and reliable.

13 Claims, 3 Drawing Sheets

(51) Int. Cl.

| | |
|---|---|
| ***B65D 5/42*** | (2006.01) |
| ***B31B 50/26*** | (2017.01) |
| *B31B 120/30* | (2017.01) |
| *B31B 110/35* | (2017.01) |

(52) U.S. Cl.
CPC ..... *B31B 2110/35* (2017.08); *B31B 2120/302* (2017.08)

(58) Field of Classification Search
USPC .... 229/120.15, 120.16, 904, 120.14, 120.17, 229/103, 120.08; 206/561, 590
See application file for complete search history.

(56) References Cited

U.S. PATENT DOCUMENTS

| | | | | |
|---|---|---|---|---|
| 3,730,419 | A * | 5/1973 | Botterman | B65D 71/72 206/563 |
| 7,484,653 | B2 * | 2/2009 | Hurtado | B65D 71/72 229/120.14 |
| 8,887,984 | B2 * | 11/2014 | Bahr | B31B 50/26 229/120.15 |
| 2006/0158733 | A1 | 7/2006 | Billen | |
| 2015/0282648 | A1 | 10/2015 | Zaccardo | |
| 2020/0002049 | A1 * | 1/2020 | Yen | B65D 5/326 |

FOREIGN PATENT DOCUMENTS

| | | | |
|---|---|---|---|
| DE | 3701606 | A1 | 8/1988 |
| DE | 4009852 | A1 | 9/1991 |
| JP | H0924933 | | 1/1997 |

* cited by examiner

PACKING BOX AND METHOD OF USING THE SAME

CROSS REFERENCE TO RELATED APPLICATION

This application claims priority to a PCT application PCT/CN2018/108660, filed on Oct. 24, 2018. PCT application is included herein by reference in its entirety.

TECHNICAL FIELD

The present invention relates to a packing box which is easy to form and saves the space during transportation, and it is generally related to field of invention of the packing box field.

BACKGROUND TECHNOLOGY

Packing boxes are very widely used in many areas, for the purpose to withhold and secure articles inside, including everyday articles like food, cosmetics, and gifts, etc.

The packing boxes can not only provide excellent support and protection for the articles within, but ensure orderly arrangement and increase exterior esthetical value of the product. When the packing box is in use, as a 3-dimensional body, it provides accommodation space for the articles within. However, when the packing boxes are not in use, the accommodation space takes too much unnecessary storage space. Additionally, in the absence of the articles inside, the empty packing boxes can sustain very little pressure on their own. When a great amount of packing boxes needs to be transported, the packing boxes cannot be heavily stacked, otherwise, the packing boxes will be easily damaged, besides that the empty packing boxes take and waste a lot of storage space.

SUMMARY OF THE INVENTION

The invention aims to provide a packing box to solve the technical problem that the packing box is not easy to store and transport because of the accommodation space thereof.

To achieve the above-mentioned objective, the invention provides the following technical solutions.

A packing box comprises a base surface, side surfaces and accommodation space or receiving compartments. The side surfaces are arranged around the base surface, and form a one-piece planar structure with the base surface.

The side surfaces and the base surface are provided with first set of folding marks, which are configured to be used so that when the side surfaces and the base surface are folded along the set of folding marks, an enclosed body of the packing box is formed.

A plurality of holes is arranged on the base surface, and the accommodation space or receiving compartments or compartments are fixed on the base surface, with the holes used as openings thereof.

Each accommodation space or compartment is surrounded by a plurality of wall surfaces, the wall surfaces include unparallel wall surfaces, which are unparallel to the base surface when the accommodation space or receiving compartments or compartments are unfolded, and parallel wall surfaces, which are parallel to the base surface when the accommodation space or receiving compartments or compartments are unfolded, and a plurality of second folding marks are provided on the unparallel wall surfaces so that corresponding wall surfaces can be fold or unfold according to the plurality of the second folding marks; wherein, when the unparallel wall surfaces are folded, the internal cavities of the accommodation space or receiving compartments or compartments disappear and the accommodation space or receiving compartments or compartments are retracted, and when the unparallel wall surfaces are unfolded, the accommodation compartments are unfolded or revealed.

Further, in the present invention, the wall surfaces of each accommodation space or compartment comprise first wall surfaces and second wall surface, wherein the first wall surfaces are the unparallel wall surfaces, the second wall surface is connected with the first wall surfaces and is the parallel wall surface, and the second folding marks parallel to the base surface are arranged on the first wall surfaces.

Further, in the present invention, the first wall surfaces are folded toward the inside of the accommodation space or receiving compartments or compartments.

Further, in the present invention, the wall surfaces of each accommodation space also comprise third wall surfaces which are fixedly connected to the base surface and form an one-piece structure with the base surface, third folding marks are disposed between the third wall surfaces and the base surface, are arranged along partial edges of the holes corresponding to the accommodation space or receiving compartments or compartments, and are used to fold the third wall surfaces along the third folding marks toward the inside of the accommodation space or receiving compartments or compartments to unfold the unparallel wall surfaces and fold the third wall surfaces along the third folding marks toward the base surface to fold the unparallel wall surfaces.

Further, in the present invention, the edges of the third wall surfaces adjacent to the third folding marks, at least, sweep through the first wall surfaces and the second folding marks thereon on the path where the third wall surfaces are folded toward the inside of the accommodation space or receiving compartments or compartments.

Further, in the invention, the radial length of the third wall surfaces along the third folding marks as the axes is equal to the depth of the accommodation space or compartments with the holes as the openings.

Further, in the invention, the hardness of the first wall surfaces of the accommodation space or compartments is lower than the hardness of the third wall surfaces.

Further, in the invention, the hardness of the base surface is higher than or equal to the hardness of the third wall surfaces.

Further, in the invention, the side surfaces comprise first side surfaces and second side surfaces which are arranged at interval and match mutually when being folded to form the vertical surfaces of the packing box;

Wherein, the first side surfaces at least comprise surfaces A, surfaces B and surfaces C which are connected in sequence, the first side surfaces are connected to the base surface through the surfaces A, first folding marks are arranged between the first side surfaces and the base surface, the surfaces A and the surfaces B have the same size, between which fourth folding marks are arranged, and fifth folding marks are arranged between the surfaces B and the surfaces C; the first folding marks, the fourth folding marks and the fifth folding marks are parallel mutually.

The first side surfaces are folded toward the inside of the base surface in sequence to form the first folding marks, the fourth folding marks and the fifth folding marks to realize folding of the first side surfaces, the surfaces A and the surfaces B overlap mutually, and the surfaces C are attached on one side of the base surface.

First bulges are arranged on the base surface near the first folding marks, with the thickness larger than the thickness of the surfaces C.

After the first side surfaces are folded, the outer edges of the surfaces C parallel to the fifth folding marks abut against the outer side walls of the first bulges close to the first folding marks.

The invention also provides a method of using the packing box, through which the unfolded packing box is assembled.

Side portion of the packing box: the side surfaces are folded toward the base surface along the first folding marks, so that a space body is formed for the packing box.

Accommodation space or receiving compartments of the packing box portion: the third wall surfaces are folded along the third folding marks toward the inside of the accommodation space or receiving compartments through the holes, so as to unfold the unparallel wall surfaces in the accommodation space or receiving compartments to form the accommodation space or receiving compartments.

Further, in the present invention, when the side portion are folded, the first side surfaces are folded toward the inside of the base surface, in sequence, folding along the first folding marks, the fourth folding marks, and the fifth folding marks, so that the surfaces A and the surfaces B overlap mutually, and the surfaces C are attached on one side of the base surface; the second side surfaces are folded toward the inside of the base surface through the first folding marks and folded toward the gaps between the surfaces A and the surfaces B through the sixth folding marks, so that the turn-over edges are located in the gaps the surfaces A and the surfaces B.

BENEFICIAL EFFECTS

As it can be seen from the above technical solutions, the technical solutions of the present invention provide a packaging box and a method of using the same, which have the following beneficial effects.

1. The accommodation space or receiving compartments and the side surfaces thereof can be completely flattened, so that the side walls, the side surfaces and the base surface of the accommodation space or receiving compartments are folded in a nearly parallel way, transportation and storage are easy, the space occupied is reduced, and the packing box cannot be crushed during transportation and storage.

2. The folding operation is easy, the side walls and the wall surfaces can be folded and unfolded through simple pushing, the packing box can be formed easily, and the time used for folding are reduced; after the third wall surfaces are folded toward the accommodation space or receiving compartments, the wall surfaces of the accommodation space or receiving compartments are automatically locked in the vertical state through certain elasticity and friction force of the material, without the need of fixing measures like adhesives; after articles are positioned in the formed accommodation space or receiving compartments, the gravity of the contained articles increases the stiffness and steadiness of the wall surfaces of the accommodation space or receiving compartment.

3. Through the folding, the vertical surfaces and the accommodation space or receiving compartments of the packing box are well fixed, and thus the steadiness of the formed packing box can be ensured.

4. The solution has a smart design and can be realized by using paper material, which is more environment-friendly than the blister or foam products with the same performance in the market.

It should be understood that all combinations of the above-mentioned idea and additional ideas described in more details hereinafter, as long as not mutually conflicting, can be seen as a part of the theme of the disclosed invention.

The above mentioned and other aspects, embodiments and features of the present teachings can be understood more comprehensively from the description below in combination with the attached drawings. Other additional aspects of the invention, e.g., the features and/or beneficial effects of the exemplary implementations will be apparent from the description below, or can be known from practices of the specific implementations of the present teachings.

BRIEF DESCRIPTION OF THE DRAWINGS

The attached drawings are not intended to be drawn to scale. In the attached drawings, the same or approximately the same elements shown in each drawing can be marked with the same symbols. For clarity purpose, not every element is marked in each drawing. The embodiments of each aspect of the invention will be described by way of examples in connection with the attached drawings now. Among the attached drawings.

Elements in the drawings are.

Figure 1:
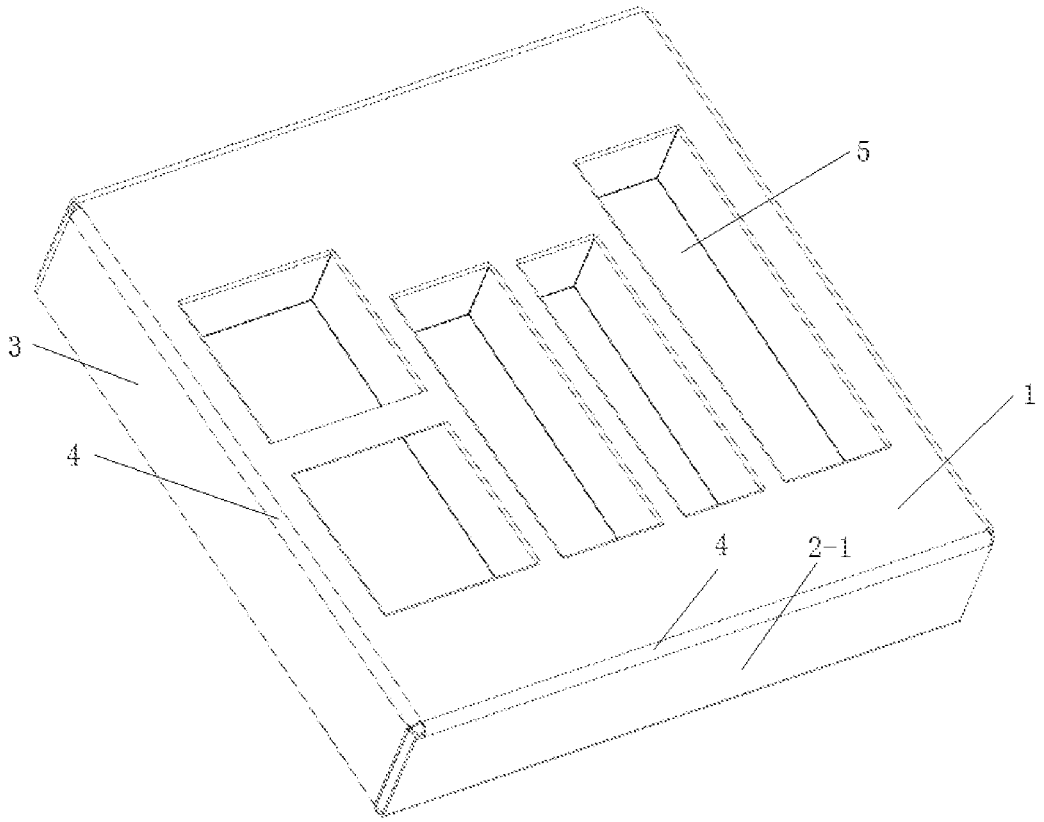
FIG. 1 is the front view of the formed packing box.
Figure 2:
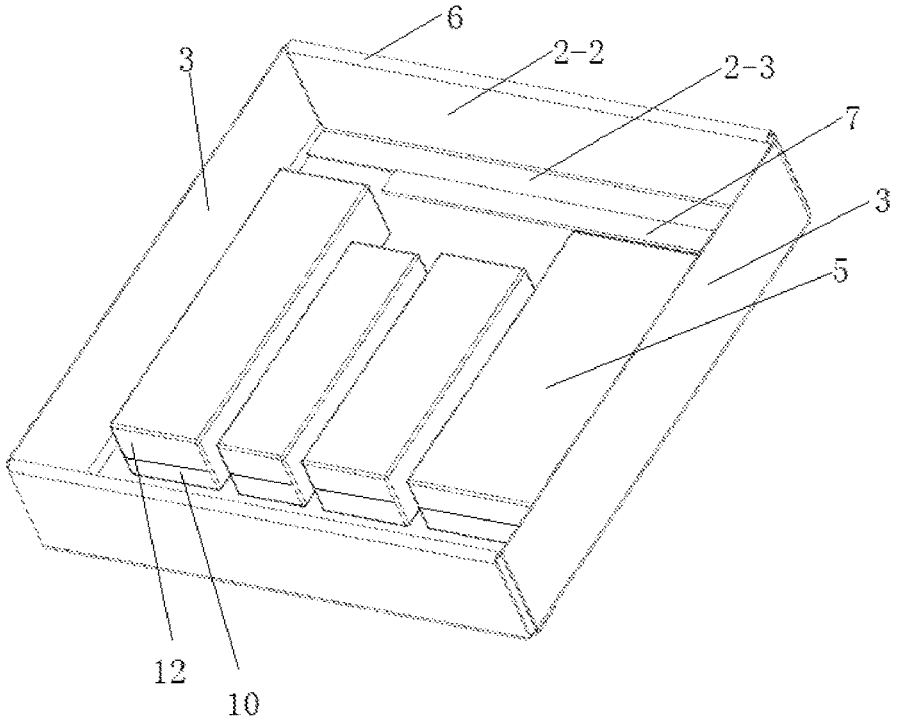
FIG. 2 is the rear view of the formed packing box.
Figure 3:
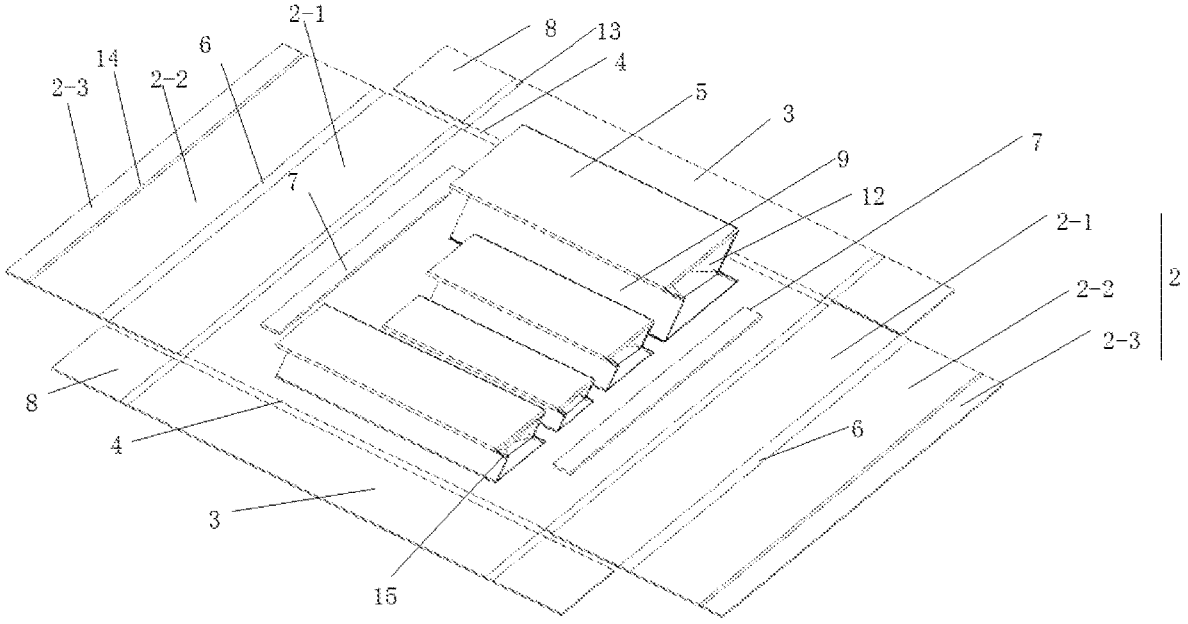
FIG. 3 is the rear view of the unfolded packing box.

The base surface 1, the first side surfaces 2, the surfaces A 2-1, the surfaces B 2-2, the surfaces C 2-3, the second side surfaces 3, the first folding marks 4, the second wall surface 5, the fourth folding marks 6, the first bulges 7, the turn-over edges 8, the first wall surfaces 9, the third wall surfaces 10, the fourth wall surfaces 12, the sixth folding marks 13, the fifth folding marks 14, the second folding marks 15 and the third folding marks 16.

SPECIFIC IMPLEMENTATIONS

To better understand the technical content of the invention, specific embodiments are illustrated in connection with the attached drawings hereinafter.

All aspects of the invention are described with reference to the attached drawings in the disclosure, and a number of embodiments described are illustrated in the attached drawings. The embodiments of the disclosure are not necessarily intended to include all the aspects of the invention. It should be understood that various ideas and embodiments presented hereinabove, as well as the ideas and implementations described hereinafter in more details can be implemented in any of many ways, since the ideas and embodiments disclosed in the invention are not limited to any implementation. In addition, some aspects disclosed in the invention can be used independently or in combination with any of other aspects disclosed in the invention.

A packing box as shown in FIGS. 1-4 comprises a base surface 1, side surfaces and accommodation space or receiving compartments.

The side surfaces are arranged around the base surface 1, and form a one-piece planar structure with the base surface 1, the side surfaces and the base surface 1 form first folding marks 4 used to fold along the first folding marks 4 and form a space body for the packing box. The match between the side surfaces and the base surface 1 and the packing box is flattened during transportation and storage; to assemble the packing box, the side surfaces match mutually, so that the side surfaces are vertical to the base surface 1 and steadily and mutually match.

In order to receive and accommodate corresponding articles in the packing box, as shown in FIG. 1, a plurality of holes is opened on the base surface 1, and the accommodation spaces or receiving compartments are fixed on the base surface 1, with the holes used as openings thereof.

Each accommodation space or compartment is surrounded by a plurality of wall surfaces, the wall surfaces include unparallel wall surfaces, which are unparallel to the base surface when the accommodation space or receiving compartments or compartments are unfolded, and parallel wall surfaces, which are parallel to the base surface when the accommodation space or receiving compartments or compartments are unfolded, and a plurality of second folding marks 15 are provided on the unparallel wall surfaces so that corresponding wall surfaces can be fold or unfold according to the plurality of the second folding marks; wherein, when the unparallel wall surfaces are folded, the internal cavities of the accommodation space or receiving compartments or compartments disappear and the accommodation space or receiving compartments or compartments are retracted, and when the unparallel wall surfaces are unfolded, the accommodation compartments are unfolded or revealed.

When the packing box is not in use, e.g., during transportation and storage, the accommodation spaces or receiving compartments are retracted, the wall surfaces of the accommodation spaces or receiving compartments are placed in order and are nearly parallel to the base surface 1, and the side surfaces and the base surface 1 are also flat as one piece. Therefore, the entire packing box occupies a space which is nearly a plane, thus reducing the space and not damaging the packing box structure when being overlaid for transportation or storage.

Specifically, the wall surfaces of the accommodation spaces or receiving compartments comprise first wall surfaces 9 and second wall surfaces 5, wherein the first wall surfaces 9 are the unparallel wall surfaces, the second wall surfaces 5 are connected with the first wall surfaces 9 and are the parallel wall surfaces, and second folding marks 15 parallel to the base surface 1 are arranged on the first wall surfaces 9. The first wall surfaces 9 and the second wall surfaces 5 match to form the main side wall surfaces of the accommodation spaces or receiving compartments.

In order to easily unfold the wall surfaces of the accommodation spaces or receiving compartments, the first wall surfaces are folded toward the inside of the accommodation spaces or receiving compartments. Accordingly, the first wall surfaces 9 and the second folding marks 15 can be pushed to unfold through the hole toward the outside of the accommodation space or receiving compartments.

Figure 4:
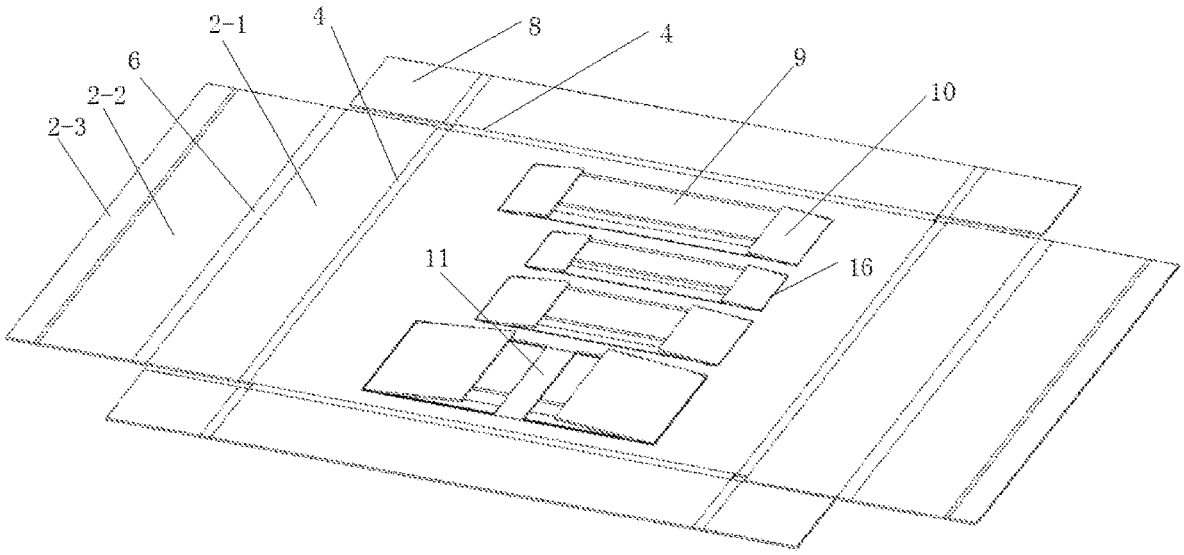
FIG. 4 is the front view of the unfolded packing box.

Further, in order to stabilize the unfolded state of the accommodation spaces or receiving compartments and unfold the wall surfaces of the accommodation spaces or receiving compartments, the wall surfaces of the accommodation spaces or receiving compartments also comprise third wall surfaces 10 which are fixedly connected to the base surface 1 and form a one-piece structure with the base surface 1, third folding marks 16 are formed between the third wall surfaces 10 and the base surface 1, and are arranged along partial edges of the holes corresponding to the accommodation spaces or receiving compartments. As shown in FIG. 4, to unfold the accommodation spaces or receiving compartments, the third wall surfaces 10 are folded along the third folding marks 16 toward the inside of the accommodation spaces or receiving compartments to unfold the unparallel wall surfaces; to fold the accommodation spaces or receiving compartments, the third wall surfaces 10 are folded along the third folding marks 16 toward the base surface 1 to fold the unparallel wall surfaces.

In order to unfold the first wall surfaces 9 effectively, the edges of the third wall surfaces 10 adjacent to the third folding marks 16, at least, sweep through the first wall surfaces 9 and the second folding marks 15 thereon on the path where the third wall surfaces 10 are folded toward the inside of the accommodation spaces or receiving compartments. Accordingly, the second folding marks 15 and the first wall surfaces 9 are pushed toward the outside of the accommodation spaces or receiving compartments by the edges of the third wall surfaces 10, so that the accommodation space or receiving compartments are unfolded, and static friction force generated through contact between the third wall surfaces 10 and the first and second wall surfaces 9 and 5 stabilizes the third wall surfaces 10. In the embodiment, the accommodation space or receiving compartments as shown in the figure are regular rectangular structures, thus the third wall surfaces 10 rotate along the third folding marks 16 by 90°, and is then vertical to the base surface; in the meantime, the third wall surfaces 10 move to position, and can act as supports for the first wall surfaces 9 to prevent retraction of the first wall surfaces 9.

Further, in the specific embodiment of the invention, in order for the third wall surfaces 10 to support the first wall surfaces 9 and the second wall surfaces 5, the radial length of the third wall surfaces 10 along the third folding marks 16 as the axes is equal to the depth of the accommodation spaces or receiving compartments with the holes as the openings, thus the first wall surfaces 9 and the second wall surfaces 5 are supported by the side edges of the third wall surfaces 10 and the accommodation space or receiving compartments are stabilized.

In order to better stabilize the accommodation space or receiving compartments and facilitate expansion and folding of the accommodation space or receiving compartments, the hardness is considered such that the hardness of the first wall surfaces 10 of the accommodation space or receiving compartments is lower than the hardness of the third wall surfaces 10, so that the third wall surfaces 10 push the first wall surfaces 9 more effectively, and better support the first wall surfaces 9 and even the second wall surfaces 5.

Further, in the embodiment of the invention, the third wall surfaces 10 are formed by extending the base surface; in consideration of using the base surface as an important supporting surface after the entire packing box is formed, in the specific embodiment of the invention, the hardness of the base surface 1 is higher than or equal to the hardness of the third wall surfaces 10.

Specifically, as shown in FIGS. 1-4, in the specific embodiment of the invention, a plurality of accommodation spaces or compartments are arranged, in each accommodation space, two first wall surfaces 9 are arranged, the second wall surface 5 is located between the two first wall surfaces 9 and forms one piece with the first wall surfaces 9, the accommodation space is fixed on the base surface 1 through the two first wall surfaces 9, and the path along which the first wall surfaces 9 are fixed with the base surface 1 is the partial edges of the hole; the two ends of the one-piece structure formed by the first wall surfaces 9 and the second wall surface 5, which are not fixed with the base surface 1, are the ends of the accommodation space.

Two third wall surfaces 10 are arranged, the third folding mark 16 between each third wall surface 10 and the base surface 1 is arranged along the hole edge except the hole edges along which the first wall surfaces 9 are fixed with the base surface 1, and is respectively corresponding to the position of each end; the two edges of the third wall surfaces 10 adjacent to the third folding marks 16 respectively sweep through the two first wall surfaces 9 and the second folding marks 4 thereon in the path in which the third wall surfaces 10 are folded toward the inside of the accommodation spaces or receiving compartments.

In the embodiment of the invention, the one-piece structures formed by the first wall surfaces 9 and the second wall surfaces 5 are made of paper material with the thickness and hardness lower than the thickness and hardness of the base surface 1, the first wall surfaces 9 are fixedly connected to the base surface 1 through gluing or another means, and the third wall surfaces 10 are made of paper material which is the same as the paper material of the base surface 1, and is fixedly connected to the base surface 1. Therefore, the third wall surfaces 10 with higher hardness and thickness can effectively support the first wall surfaces 9 and the second wall surfaces 5.

Preferably, in the specific embodiment of the invention, fourth wall surfaces 12 are also arranged on each accommodation space, the fourth wall surfaces 12 are arranged on the end surfaces formed by the ends and are mutually connected with the first wall surfaces 9 and the second wall surface 5, and sixth folding marks 13 are arranged on the fourth wall surfaces 12 to fold and unfold the fourth wall surfaces 12. The fourth wall surfaces 12 are used to match the first wall surfaces 9 and the second wall surface 5 to form the side walls of the accommodation space, and can also be used as stops for the third wall surfaces 10 which move to position, and thus the third wall surfaces 10 overlap with the fourth wall surfaces 12 after moving to position.

In the specific embodiment of the invention, the fourth wall surfaces 12 and the second wall surfaces 5 form one-piece structures, and are fixed on the first wall surfaces through gluing or another means.

In the specific embodiment of the invention, the side surfaces mentioned in the above solution are also designed in a new way, which will be described hereinafter.

The side surfaces comprise first side surfaces 2 and second side surfaces 3 which are arranged at interval and match mutually when being folded to form the vertical surfaces of the packing box.

Wherein, the first side surfaces 2 at least comprise surfaces A 2-1, surfaces B 2-2 and surfaces C 2-3 which are connected in sequence, the first side surfaces 2 are connected to the base surface 1 through the surfaces A 2-1, first folding marks 4 are arranged between the first side surfaces 2 and the base surface 1, the surfaces A 2-2 and the surfaces B 2-2 have the same size, between which fourth folding marks 6 are arranged, and fifth folding marks 14 are arranged between the surfaces B 2-2 and the surfaces C 2-3; the first folding marks 4, the fourth folding marks 6 and the fifth folding marks 14 are parallel mutually.

The first side surfaces 2 are folded toward the inside of the base surface 1 in sequence to form the first folding marks 4, the fourth folding marks 6 and the fifth folding marks 14 to realize folding of the first side surfaces 2, the surfaces A 2-1 and the surfaces B 2-2 overlap mutually, and the surfaces C 2-3 are attached on one side of the base surface 1.

First bulges 7 are arranged on the base surface 1 near the first folding marks 4, with the thickness larger than the thickness of the surfaces C 2-3.

After the first side surfaces 2 are folded, the outer edges of the surfaces C 2-3 parallel to the fifth folding marks 14 abut against the outer side walls of the first bulges 7 close to the first folding marks 4. Therefore, after being folded, the first side surfaces 2 can be firmly positioned through abutting between the surfaces C 2-3 and the first bulges 7 and the elasticity of the material without additional fixing. In order to better attach the surfaces C 2-3, the first bulges 7 are preferably long strips with the length equal to or slightly less than the length of the surfaces C 2-3.

Similarly to the existing technology, turn-over edges 8 are arranged on the second side surfaces 3, and sixth folding marks 13 are arranged between the turn-over edges 8 and the second side surfaces 3 such that the second side surfaces 3 are folded toward the inside of the base surface 1 through the first folding marks 4 and folded toward the gaps between the surfaces A 2-1 and the surfaces B 2-2 through the sixth folding marks 13, so that the turn-over edges 8 are located in the gaps the surfaces A 2-1 and the surfaces B 2-2.

Therefore, the side surfaces match mutually to form steady vertical surfaces, and the originally flat packing box becomes a stereoscopic structure.

The specific embodiment of the invention also discloses a method of using the packing box, through which the unfolded packing box is folded.

Side portion: the side surfaces are folded toward the base surface 1 along the first folding marks 4, so that a space is formed for the packing box;

Accommodation space part: the third wall surfaces 10 are folded along the third folding marks 16 toward the inside of the accommodation spaces or compartments through the holes, so as to unfold the unparallel wall surfaces in the accommodation spaces or compartments to form the accommodation spaces or compartments.

Wherein, when the side parts are folded, the first side surfaces 2 are folded toward the inside of the base surface 1 in sequence to form the first folding marks 4, the fourth folding marks 6 and the fifth folding marks 14, so that the surfaces A 2-1 and the surfaces B 2-2 overlap mutually, and the surfaces C 2-3 are attached on one side of the base surface 1; the second side surfaces 3 are folded toward the inside of the base surface 1 through the first folding marks 4 and folded toward the gaps between the surfaces A 2-1 and the surfaces B 2-2 through the sixth folding marks 13, so that the turn-over edges 8 are located in the gaps the surfaces A 2-1 and the surfaces B 2-2.

By using the packing box and the using method in the specific embodiment of the invention, the space can be reduced during packing box transportation and storage, the packing box can be used very conveniently and quickly without the need of additional fixing tools, and a steady and reliable structure can be formed finally. Therefore, the packing box and the using method have broad application prospect.

The invention has been disclosed above by way of a preferred embodiment; however, the preferred embodiment is not intended to limit the invention. Those of ordinary knowledge of the technical field of the invention may make various changes and modifications, without departing from the spirit and scope of the invention. Therefore, the protection scope of the invention shall be limited by the protection scope of the claims.

The invention claimed is:

1. A packing box, wherein the packing box comprises a base surface, side surfaces and receiving compartments;

the side surfaces are arranged around the base surface, and form a one-piece planar structure with the base surface, the side surfaces and the base surface are provided with first set of folding marks, which are configured to be used so that when the side surfaces and the base surface are folded along the first set of folding marks, an enclosed body of the packing box is formed;

a plurality of holes is disposed on the base surface, and the receiving compartments are fixed on the base surface, with surrounding edges of the holes as top edges of the receiving compartments;

each receiving compartment is surrounded by a plurality of wall surfaces, the wall surfaces include unparallel wall surfaces, which are unparallel to the base surface when the receiving compartments are unfolded, and parallel wall surfaces, which are parallel to the base surface when the receiving compartments are unfolded;

and a set of second folding marks are provided on the unparallel wall surfaces to be used to erect and expand the corresponding wall surfaces;

wherein, when the unparallel wall surfaces are folded, internal cavities of the receiving compartments disappear and the receiving compartments are retracted, and when the unparallel wall surfaces are unfolded, the receiving compartments are expanded;

wherein the wall surfaces of each receiving compartment or compartment comprise first wall surfaces and second wall surface, wherein the first wall surfaces are the unparallel wall surfaces, the second wall surface is connected with the first wall surfaces and is the parallel wall surface, and the second set of folding marks, parallel to the base surface, are disposed on the first wall surfaces;

the wall surfaces of each receiving compartment also comprise third wall surfaces which are fixedly attached to the base surface and form a one-piece integral structure with the base surface, third set of folding marks are disposed between the third wall surfaces and the base surface, are arranged along partial edges of the holes of the corresponding receiving compartment.

2. The packing box according to claim 1, characterized in that the first wall surfaces are folded toward the inside of the receiving compartments.

3. The packing box according to claim 2, wherein said third set of folding marks are used as a folding guide for the third wall surfaces when the third wall surfaces are folded toward the inside of the receiving compartments, leading the unparallel wall surfaces to unfold, and when the third wall surfaces are folded toward the base surface, leading the unparallel wall surfaces to fold.

4. The packing box according to claim 3, characterized in that the edges of the third wall surfaces, adjacent to the third set of folding marks, at least, sweep through the first wall surfaces and the second folding marks thereon on the path where the third wall surfaces are folded toward the inside of the receiving compartments.

5. The packing box according to claim 4, characterized in that a radial length of the third wall surfaces along the third set of folding marks is equal to the depth of the receiving compartments when the holes are openings.

6. The packing box according to claim 4, characterized in that in each receiving compartment, two of the first wall surfaces are provided, one second wall surface is located between the two first wall surfaces and forms one integral structure with the two first wall surfaces, the receiving compartment is folded and formed on the base surface through the two first wall surfaces, and the path along which the first wall surfaces are fixed with the base surface is to along the partial edges of the hole;

two ends of the one-piece integral structure formed by the first wall surfaces and the second wall surface, which are not fixedly attached with the base surface, are the ends of the receiving compartment;

two of the third wall surfaces are provided, third set of folding marks between each third wall surface and the base surface is disposed along the edge of the hole, except where the first wall surfaces are fixedly attached with the base surface, and is respectively corresponding to the position of each end of the receiving compartment;

the two edges of the third wall surfaces, adjacent to the third set of the folding marks respectively, sweep through the two first wall surfaces and the second folding marks thereon in the path where the third wall surfaces are folded toward the inside of the receiving compartments.

7. The packing box according to claim 6, characterized in that fourth wall surfaces are also provided on each receiving compartment, the fourth wall surfaces are arranged on end surfaces formed by the ends of the receiving compartments, and are mutually connected with the first wall surfaces and the second wall surface, and sixth set of folding marks are disposed on the fourth wall surfaces configured to be used to fold and unfold the fourth wall surfaces.

8. The packing box according to claim 7, characterized in that turn-over edges are provided on the second side surfaces, and sixth set of folding marks are provided between the turn-over edges and the second side surfaces, so that when the second side surfaces are folded toward the inside of the base surface through the first set of folding marks and further folded toward the gaps between the surfaces A and the surfaces B through the sixth folding marks, the turn-over edges are located in the gaps the surfaces A and the surfaces B.

9. The packing box according to claim 3, characterized in that a hardness of the first wall surfaces of the receiving compartments is smaller than the hardness of the third wall surfaces.

10. The packing box according to claim 9, characterized in that the hardness of the base surface is greater than or equal to the hardness of the third wall surfaces.

11. A method of using a packing box, comprising providing the packing box of claim 3, unfolding the packing box, comprising the steps of according to any of claim 3, characterized in that the unfolded packing box is folded by using the following method:

Side portion: folding the side surfaces are folded toward the base surface along the first folding marks, for the side portion of the packing box, so that a space body is formed for the packing box;

Receiving compartment portion: folding the third wall surfaces are folded along the third set of folding marks toward the inside of the receiving compartments through the holes, for the receiving compartment portion of the packing box, so as to unfold the unparallel wall surfaces in the receiving compartments to form the receiving compartments.

12. The method of using the packing box according to claim 11, characterized in that further comprising the steps of when the side portion are folded, folding the first side surfaces are folded toward the inside of the base surface, to fold along the folding marks, sequentially in the order of, along the first set of folding marks, the fourth set of folding marks, and the fifth set of folding marks, so that the surfaces A and the surfaces B overlap mutually, and the surfaces C are attached on one side of the base surface;

folding the second side surfaces are folded toward the inside of the base surface through the first set of folding marks and folded toward the gaps between the surfaces A and the surfaces B through the sixth set of folding marks, so that the turn-over edges are located in the gaps between the surfaces A and the surfaces B.

13. The packing box according to claim 1, characterized in that the side surfaces comprise first side surfaces and second side surfaces, which are disposed alternate to each other, and match mutually when being folded to form the vertical surfaces of the packing box;

wherein, the first side surfaces at least comprise surfaces A, surfaces B and surfaces C, which are connected sequentially in that order;

the first side surfaces are connected to the base surface through the surfaces A, the first set of folding marks are disposed between the first side surfaces and the base surface, the surfaces A and the surfaces B have same sizes, and between them, a fourth set of folding marks are arranged, and a fifth set of folding marks are arranged between the surfaces B and the surfaces C;

the first set of the folding marks, the fourth set of folding marks and the fifth set of folding marks are all parallel to each other;

the first side surfaces are configured to be folded toward the inside of the base surface, in sequence, from the first folding marks, the fourth folding marks and to the fifth folding marks, to realize folding of the first side surfaces, the surfaces A and the surfaces B overlap mutually, and the surfaces C are attached on one side of the base surface;

a first protrusion is provided on the base surface near the first set of folding marks, and the thickness of the first protrusion is higher than the thickness of the C surface;

after the first side surfaces are folded, the outer edges of the surfaces C parallel to the fifth folding marks abut against the outer side walls of the first bulges close to the first set of the folding marks.

* * * * *